US009326339B2

(12) United States Patent
Nieberlein et al.

(10) Patent No.: US 9,326,339 B2
(45) Date of Patent: Apr. 26, 2016

(54) LED LIGHTING DEVICE WITH CONTROL MEANS AND METHOD FOR OPERATING THE LED LIGHTING DEVICE

(71) Applicant: Diehl Aerospace GmbH, Ueberlingen (DE)

(72) Inventors: Uwe Nieberlein, Roth (DE); Stefan Dobler, Neunkirchen am Brand (DE); Guenther Koeninger, Neuhof (DE)

(73) Assignee: DIEHL AEROSPACE GMBH, Ueberlingen (DE)

( * ) Notice: Subject to any disclaimer, the term of this patent is extended or adjusted under 35 U.S.C. 154(b) by 218 days.

(21) Appl. No.: 13/851,520

(22) Filed: Mar. 27, 2013

(65) Prior Publication Data

US 2013/0257300 A1 Oct. 3, 2013

(30) Foreign Application Priority Data

Mar. 28, 2012 (DE) ..... 10 2012 006 343

(51) Int. Cl.
*H05B 33/08* (2006.01)

(52) U.S. Cl.
CPC ..... *H05B 33/083* (2013.01)

(58) Field of Classification Search
CPC ..... H05B 33/083
USPC ..... 315/193
See application file for complete search history.

(56) References Cited

U.S. PATENT DOCUMENTS

| | | | | |
|---|---|---|---|---|
| 6,989,807 | B2 | 1/2006 | Chiang | |
| 7,781,979 | B2 | 8/2010 | Lys | |
| 2008/0094000 | A1 | 4/2008 | Yamamoto et al. | |
| 2009/0066267 | A1 | 3/2009 | Kraus et al. | |
| 2010/0308738 | A1* | 12/2010 | Shteynberg et al. | 315/185 R |
| 2011/0227484 | A1 | 9/2011 | Huynh | |
| 2011/0248640 | A1 | 10/2011 | Welten | |
| 2011/0273103 | A1* | 11/2011 | Hong | 315/193 |

FOREIGN PATENT DOCUMENTS

| | | | |
|---|---|---|---|
| DE | 102007040152 | A1 | 3/2008 |
| DE | 102007041131 | A1 | 3/2009 |
| DE | 102010040266 | A1 | 9/2011 |
| DE | 20 2011 105 404 | U1 | 2/2012 |
| EP | 2288234 | A1 | 2/2011 |

* cited by examiner

*Primary Examiner* — Haissa Philogene
*Assistant Examiner* — Pedro C Fernandez
(74) *Attorney, Agent, or Firm* — Scully, Scott, Murphy & Presser, P.C.

(57) ABSTRACT

An LED lighting device for AC voltage supply is provided. The device has LEDs that are divided into multiple LED part groups. A supply voltage is provided to the device. The LED part groups provides a plurality of LED strands each formed by a certain number of LED part groups arranged in series with each other. The device has shorting links each for bridging one of the LED part groups in an LED strand. The device also has a control means for controlling the shorting links to place the LED strands in at least two switch states. The through voltages of the LED strands are different, when the LED strands are in the switch states, respectively.

10 Claims, 5 Drawing Sheets

LED LIGHTING DEVICE WITH CONTROL MEANS AND METHOD FOR OPERATING THE LED LIGHTING DEVICE

BACKGROUND

The invention concerns an LED lighting device for an AC voltage supply, with several LEDs forming a whole chain, whereby the LEDs are divided into LED part groups, whereby a supply voltage with alternating amplitude is present in the LED lighting device, whereby several LED part groups are positioned in series to each other and form an LED strand. The invention further concerns a method for operating the LED lighting device.

LED lights are increasingly used for lighting rooms and suchlike, as they can realise a high optical yield with a simultaneously low energy requirement. If one compares LED lights with classic filament lamps it is clear that the operation of lights with a classic filament bulb with an alternating voltage supply is much simpler than that of LED lights. Whilst classic filament lamps can be supplied with alternating voltage without problem, whereby one needs only monitor the height of the alternating voltage, LED lights can be operated only within a very limited voltage range. With an LED light a minimum voltage must be exceeded on the one hand in order to make the LED light up, whilst too much current flows through the LED light if too high a voltage is applied on the other, so that the same will fail after a short period of time without active cooling.

The working window with regard to working voltage for supplying the LED light is therefore comparatively small. In particular it is not possible to connect an LED light directly to an alternating voltage supply, as an operation of the LED light is not possible due to the widely varying voltage values.

DE 20 2011 105 404 U1 lists various voltage supply possibilities for LEDs, whereby it is also pointed out that light-emitting diodes can be supplied from an alternating voltage source, whereby a bridge rectifier is located between the light-emitting diodes together with possible series resistors, so that the light-emitting diodes are supplied with a pulsating current.

SUMMARY

As part of the invention an LED lighting device designed for an alternating voltage supply is disclosed. An alternating voltage supply can for example consist of a public electricity network with an effective network voltage of 230 Volt and a network frequency of 50 Hertz. The alternating voltage supply preferably comprises an effective voltage of 115 Volt and a network frequency of between 400 Hertz and 800 Hertz, whereby such an alternating voltage supply can for example be provided on an aeroplane.

The LED lighting device comprises several LEDs (light-emitting diode), which form a whole chain. These several LEDs can for example be realised as white LEDs, red LEDs, green LEDs or blue LEDs, or as a mixture of the same. In a preferred embodiment all LEDs are realised as white LEDs. The whole chain represents an electric interconnection of several LEDs, whereby the whole chain is supplied with energy via a common, in particular bipolar connection. Inside this whole chain the several LEDs can be arranged electrically parallel, in series to each other, or in a mixed form.

The LEDs, in particular all LEDs of the whole chain, are organised or divided into LED part groups, whereby at least one LED is present in each LED part group. In the smallest embodiment of the invention exactly one LED is therefore located in each LED part group, whereby a preferred embodiment of the invention comprises a multitude of LEDs in each LED part group. The LEDs can be arranged electrically parallel or in series to each other or in a mixed form within the LED part group. Each LED part group also comprises its own, in particular bipolar connection with the energy supply.

Due to the alternating voltage supply a supply voltage with alternating amplitude is applied. In one possible embodiment of the invention the LED lighting device comprises an optional mains filter, a rectifier and a PFC module, which together generate the supply voltage with alternating amplitude from the alternating voltage supply. In a special embodiment the supply voltage is designed as a rectified alternating voltage, in particular a rectified sinusoidal alternating voltage.

At least one LED strand is located within the whole chain, whereby several LED part groups are arranged in series to each other in the LED strand. With the serial switching of the LED part groups the LED part groups are switched consecutively or one after the other. This type of switching is also known as series connection.

As part of the invention it is suggested to envisage several shorting links, each designed to bridge one of the LED part groups in the LED strand. The shorting links are preferably designed to be switchable or controllable, whereby the same are activated depending on their condition and the associated LED part group is bridged by means of shorting or by-passing or made inactive, so that a current flows or can flow through the LED part group. Each one of the LED part groups is preferably allocated to one of the shorting links. Each LED part group preferably comprises a shorting link.

The LED lighting device further comprises a control means, designed for controlling the shorting links, so that the condition of shorting links can be changed from active to inactive and vice versa. The control of the shorting links is realised in such a way that the LED strand can be placed in at least two switch states, whereby the at least two switch states differ in the through voltage of the LED strand. The through voltage—also known as forward bias—is in particular understood as the threshold voltage that must be applied before the LEDs of the non-bridged LED part groups in the LED strand can light up.

It is one thought of the invention that the LED strand, and therefore the whole chain, can or could comprise different through voltages depending on the interconnection of the LED strand. If one for example switches two LED part groups with only one LED each with a forward bias of 3.4 Volt in series, the common through voltage will be 6.4 Volt. If one of the shorting links is activated, so that one of the LED part groups is shorted, the through voltage will be 3.4 Volt. The possibility of changing the switch states therefore achieves that the through voltage of the LED strand, and thus the whole chain, can be adjusted by changing the switch state.

The LED lighting device of the invention therefore makes it possible that the through voltage of the whole chain can be flexibly adjusted to suit the changing amplitude of the supply voltage. In this way it is possible that a part quantity of the LEDs can be operated within an acceptable working window with regard to the voltage height without letting the losses due to series resistors become too great, and whilst another part quantity of the LEDs is switched off at least temporarily.

With one preferred embodiment of the invention the control means is designed to control the shorting links in such a way that the switch state that has the highest through voltage is activated, whereby the through voltage is smaller than or equal to the current supply voltage. This means that the switch state that will make the best use of the through voltage is preferably always selected. With this method of operation an overheating of the LEDs due to high voltages is avoided and the LEDs are simultaneously operated within an energy efficient range.

With a particularly preferred switching technical realisation of the invention the control means is designed as a programmable, in particular digital data processing means. The control means can for example be realised as a micro-controller, DSP or FPGA. This realisation has the advantage that the complex control of the shorting links can be flexibly adjusted by programming the data processing means.

With one preferred embodiment of the invention the control means is designed for random access to the shorting links of the at least one LED strand. The possibility of activating and deactivating the shorting links independently from each other via the control means is thus provided. This embodiment of the invention has the advantage that a particularly high flexibility is possible during the selection of the shorting links.

With one preferred embodiment of the invention the control means is designed for controlling the shorting links in such a way that the LED strand can be placed into several variants of a switch state.

The different variants of the switch state comprise the same through voltage of the LED strand, whilst the selection of the bridged LED part groups is however different from one variant to the next. If one views the LED part groups with the associated shorting links of the LED strand as elements of a quantity, then the elements with deactivated shorting links form a (real) part quantity with those LED part groups that are activated in this switch state. With one variant of the switch state a second (real) part quantity of the quantity with LED part groups is formed with deactivated shorting links, whereby the first and the second part quantity are uneven.

The advantage of several variants lies in that the control means can for example be designed in such a way that all or most of the LEDs of the LED strand can be or are activated for the same length in a preferred operating mode for an average period. A further advantage of the different variants is that LEDs can be activated in different positions, so that even lighting can be achieved even with a greater number of deactivated LEDs in the LED strand through using different variants for an average period. The variants can also be optionally supplemented in order to activate differently coloured LED part groups depending on a desired overall colour of the LED strand without changing the through voltage of the LED strand.

With one preferred embodiment of the invention it is envisaged that the waveform of the supply voltage is formed by a repeating wave section. If the supply voltage is for example designed as a rectified sinusoidal alternating voltage, each wave section is designed as a sinusoidal half-wave. The at least two switch states are regularly taken up during one of the wave sections. With an increasing edge it is thus possible to regularly change from one switch state to another one of the switch states, whilst a decreasing edge of the wave section changes switch states in the opposite direction. This design emphasises that the adjustment of switch states is realised in a highly dynamic way, namely during the repeating wave section. In particular the adjustment of switch states is realised within a wave section. This does in particular not concern a static change of the switch state that would extend across several wave sections. In this way the whole chain is preferably adjusted on average by means of at least one, preferably at least two, and in particular at least four switching changes to suit the current value of the supply voltage during a wave section.

With a possible embodiment of the invention the whole chain comprises several such LED strands, whereby the LED strands are switched electrically parallel with each other. In this way it is for example possible that two, three, four or more LED strands are switched parallel with each other within the whole chain. It is preferably envisaged that the control means is designed for controlling all shorting links of several of such LED strands. This design allows that several LED strands are operated in parallel with each other and can, in particular, be controlled in such a way that the LED strands are each in the same condition, but optionally take up different variants of the same switch state. It is thus possible with this design to adjust the whole chain to the supply voltage, in particular the current value of the supply voltage, and to simultaneously use different variants of the switch states of several LED strands in order to activate different LEDs or LED part groups, especially if the whole chain is of the same overall colour—with the above mentioned advantages.

With one preferred embodiment of the invention it is envisaged that at least the single LED strand, and preferably each one of the LED strands, comprises an accumulative switching means, whereby the accumulative switching means is switched in electrical series with the LED part groups in the associated LED strand. It is envisaged that the control means is additionally designed to control the accumulative switching means. The accumulative switching means is in particular designed to interrupt at least one contact of the associated LED strand and/or the LED strand itself in its entirety. This embodiment opens up additional design possibilities for the operation of the LED lighting devices, and in particular of the whole chain. In this way it is for example possible to activate or deactivate different LED strands via the relevant associated accumulative switching means. The control means can therefore firstly adjust the through voltage of the whole chain, and secondly control the power distribution within the whole chain by activating or deactivating LED strands.

With one possible embodiment of the invention it can for example be envisaged that the LED strands and/or the LED part groups are of a different overall colour, so that an overall colour of the whole chain can be set by activating or deactivating the LED strands or the shorting links.

It is especially preferred that the control means comprises a bus interface, in particular a network interface for digital communication via a network. In particular the bus interface is designed for receiving a digital protocol message. The control means is further designed for interpreting the digital protocol message, and in particular for extracting or deducing brightness value and/or a colour value from the protocol message. The control means is preferably designed to control the whole chain in such a way that the brightness value and/or the colour value of the whole chain is set.

The LED strands preferably each comprise only LED part groups and/or LEDs of a single colour. Each LED strand is particularly preferably limited to a single colour of the LED part groups, in particular of the LEDs. One LED strand will therefore comprise only red LEDs and/or one LED strand only green LEDs and/or one LED strand only blue LEDs and/or one LED strand only white LEDs. Each single LED strand particularly preferably comprises LEDs of only one colour. This design has the advantage that the LEDs or LED part groups can be selectively activated or deactivated via the shorting links of an LED strand depending on the supply voltage applied, without changing the overall colour of the LED strand or the whole chain. The accumulative switching means and the shorting links are designed independent from each other and/or can be controlled independent from each other.

Each one of the red LEDs and/or green LEDs and/or blue LEDs preferably has a light yield that is greater than 60 Lumen/Watt, preferably greater than 100 Lumen/Watt, in particular greater than 120 Lumen/Watt. The LEDs are particularly preferably designed as high performance LEDs. The LEDs are particularly preferably designed for a current consumption during operation of more than 30 mA, in particular of more than 50 mA, and especially of more than 65 mA and/or the LED lighting device is designed for supplying the activated LEDs with the said current during operation.

With one preferred embodiment of the invention the LED lighting device comprises a current sink switched in series (or in a row) with the whole chain. The supply voltage and a supply current are applied to the current sink. The current sink is designed for settling a chain current for the whole chain, so that the time curve of the supply current is synchronised with the time curve of the supply voltage or the time curve of a mains voltage of the AC voltage supply.

This embodiment of the invention is based on the thought that a very uneven current would flow through the whole chain through changing the switch states and the changing amplitude of the supply voltage without further measures. The current through the whole chain is once again known as a chain current here. Based on this irregular chain current one would firstly assume a similarly irregular mains current from the AC voltage supply, and secondly a very irregular brightness emitted by several LEDs. In order to reduce these effects the current sink ensures that the chain current is always selected in such a way that the supply current is optionally synchronised with the time curve of the supply voltage or the time curve of the mains voltage of the AC voltage supply. The said time curves can be included in the current sink as a reference variable. The current sink can for example comprise a controllable internal resistance, the size of which is calculated by means of the quotient of the differential voltage between supply voltage or mains voltage and the current through voltage of the whole chain, divided by the desired supply current. In particular the current sink is controlled or regulated in such a way that a performance factor of the LED lighting device remains high.

With one possible embodiment of the invention the control means is designed to close all shorting links and all accumulative switching means during one activation period when, or as long as, the supply voltage is smaller than the smallest through voltage of the at least two switch states. In particular the control means is designed to control a closing of the accumulative switching means and shorting links at the start and the end of a wave section of the supply voltage when, or as long as, the supply voltage is smaller than the smallest through voltage of the at least two switch states. With this embodiment it can be ensured that the whole chain is bridged at the start and the end of each wave section for as long as the supply voltage is insufficient to light up the LEDs of the whole chain.

Optionally it can be envisaged that the supply current, i.e. chain current available thanks to the open accumulative switching means is destroyed by the current sink or transformed into heat in order to maintain the performance factor of the LED lighting device.

A further object of the invention concerns a method for operating the LED lighting device described previously, or according to one of the preceding claims, whereby the control means places the LED strand in one of the two switching positions depending on a current supply voltage.

BRIEF DESCRIPTION OF THE DRAWINGS

Further characteristics, effects and advantages of the invention result from the following description of a preferred embodiment of the invention and the enclosed drawings, whereby.

DETAILED DESCRIPTION OF EXEMPLARY EMBODIMENTS

Figure 1:
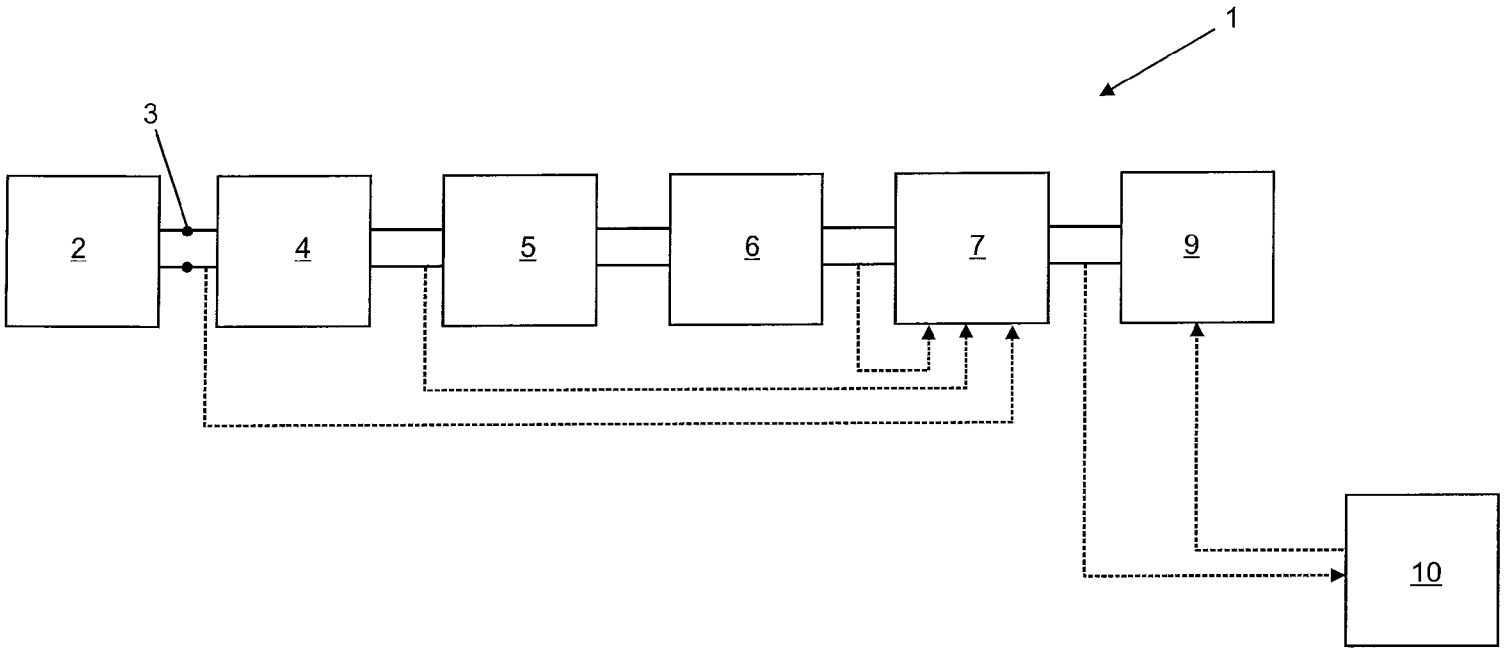
FIG. 1 shows a schematic block diagram of an LED lighting device as one embodiment of the invention.

FIG. 1 shows a schematic block diagram of an LED lighting device 1 designed for operation with an AC voltage supply 2. The LED lighting device 1 for example serves for lighting the interior of an airplane within the passenger cabin. The LED lighting device 1 is connected to the AC voltage supply 2, from which it obtains mains voltage and a mains current. The input 3 of the LED lighting device 1 is followed by an optional mains filter 4, which is designed to filter interference which may be fed back to the AC voltage supply 2. In particular it concerns a low-pass filter, which is for example formed by switching condensers and inductivities.

The mains filter 4 is followed by a rectifier 5 designed for transforming the applied mains voltage, or the filtered mains voltage, into a rectified supply voltage. The rectifier 5 is for example designed as a bridge rectifier. The rectified supply voltage as well as the rectified supply current is transmitted to a PFC module 6 comprising a harmonic frequency filter or a performance factor correction filter as well as smoothing means such as for example a condenser. At least one switching element is located in the performance correction filter, so that the performance factor correction filter is designed as a cycled system or the combination of rectifier 5 and PFC module 6 designed as a switching power supply.

The PFC module 6 provides a supply voltage and a supply current, which are subsequently transferred to a current sink 7—also known as an electronic load. The current sink 7 is designed, regulated or controlled for destroying current and therefore performance by means of conversion into heat.

From the current sink 7 a chain voltage and a chain current are transmitted to an LED whole chain 9—also known as just a whole chain—with a multitude of LEDs.

The LED lighting device 1 further comprises a control means 10, which—as shown here—can be designed as a single component or as several components designed for controlling the LED whole chain 9.

The control means 10 receives the chain voltage, which also equals the supply voltage, as an input signal. Alternatively the control means 10 receives the supply voltage as the input signal. The control means 10 can for example be designed as a programmable micro-controller.

The LED whole chain 9 can be switched to different switch states via the control means 10, as is explained with reference to FIG. 2*a, b, c:*

Figure 2C:
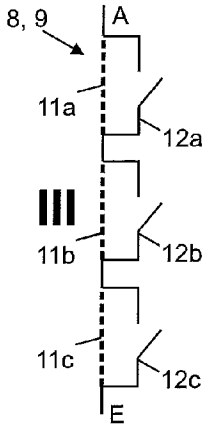
FIG. 2*a, b, c* show a schematic illustration of a whole chain of LEDs of FIG. 1 in different switch states.
Figure 2B:
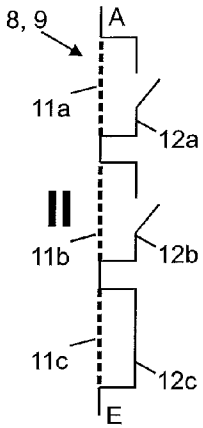
Figure 2A:
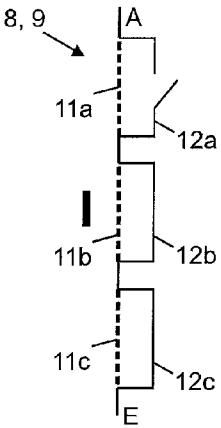

FIG. 2*a* shows the LED whole chain 9 as a schematic illustration. The LED whole chain 9 comprises an input E and an output A (or a first and a second pole), via which the LED whole chain 9 is connected to the voltage supply shown in FIG. 1.

In this example the LED whole chain 9 comprises three LED part groups 11*a, b, c*, whereby each LED part group 11*a, b, c* comprises at least one LED. In particular each LED part group 11*a, b, c* comprises the same through voltage (also called forward bias). The LED part groups 11*a, b, c* can—as is symbolically illustrated in FIG. 2*a, b, c*—be switched in series (i.e. in a row) with each other in each LED part group 11*a, b, c*. In modified embodiment examples the LEDs can also be switched parallel, in series, or mixed parallel and in series with each other in the LED part groups 11*a, b, c*. In this embodiment example each LED part group has the same through voltage.

In the whole chains 9 shown in FIG. 2*a, b, c* the three LED part groups 11*a, b, c* are arranged in electrical series with each other. The LED part groups 11*a, b, c* switched in series simultaneously also form an LED strand 8 in the LED whole chain 9. A shorting link 12*a, b, c* is allocated to each of the LED part groups 11*a, b, c*, and can bridge the corresponding or associated LED part groups 11*a, b, c*. The shorting link 12*a, b, c* thus forms a switchable by-pass for the associated LED part groups 11*a, b, c*.

In the first switch state I shown in FIG. 2*a* the shorting link 12*a* is open and the shorting links 12*b, c* closed. The through voltage of the whole chain 9 between input E and output A therefore equals the through voltage of the LED part group 11*a*.

In FIG. 2*b* a second switch state II of the same whole chain 9 is illustrated, whereby the shorting links 12*a* and 12*b* are open in switch state II, and shorting link 12*c* is closed, so that the through voltage of the whole chain 9 between input E and output A equals the sum of the through voltage of the LED part groups 11*a, b*.

In FIG. 2*c* a third switch state III of the whole chain 9 is illustrated, whereby all three shorting links 12*a, b, c* are open in this switch state III, so that the through voltage of the whole chain 9 equals the sum of the through voltages of the LED part groups 11*a, b, c*.

Figure 3B:
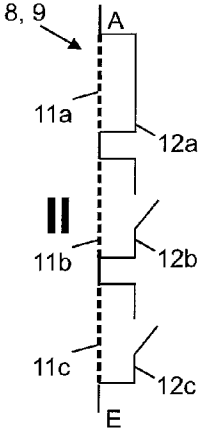
FIG. 3*a, b* show the whole chains in the switch states of FIG. 2*a, b*, each in one variant of the switch state.
Figure 3A:
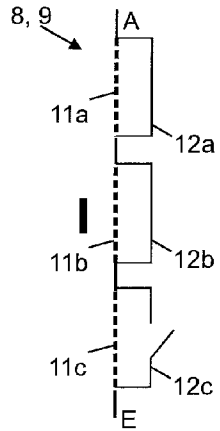

In FIG. 3*a* a variant of the switch state I of FIG. 2*a* is illustrated, whereby shorting link 12*c* is open instead of shorting link 12*a*, and the other two shorting links 12*a, b* are closed. In the same way FIG. 3*b* shows a variant of the switch state II of FIG. 2*b*, whereby shorting link 12*a* is closed instead of shorting link 12*c*, and the other shorting links 12*b, c* are open.

Upon each transition from one switch state to a next switch state the through voltage of the whole chain 9 is changed at the same time. If one describes the through voltage between input E and output A in FIG. 2*c* as the maximum through voltage of the whole chain 9, then the through voltage in switch state I of FIGS. 2*a*, 3*a* is a third of the maximum through voltage of the whole chain 9. In switch state II of FIGS. 2*b* and 3*b* the through voltage is two thirds of the maximum through voltage in switch state III.

The control means 10 is designed for switching the whole chain 9 into the different switch states I, II, III as well as their variants. A corresponding control switch for this type of switching can for example be realised with the aid of diodes and transistors. It is also possible that the shorting inks 12*a, b, c* are controlled by means of control signals from the control means 10 designed as a micro-controller.

Figure 4:
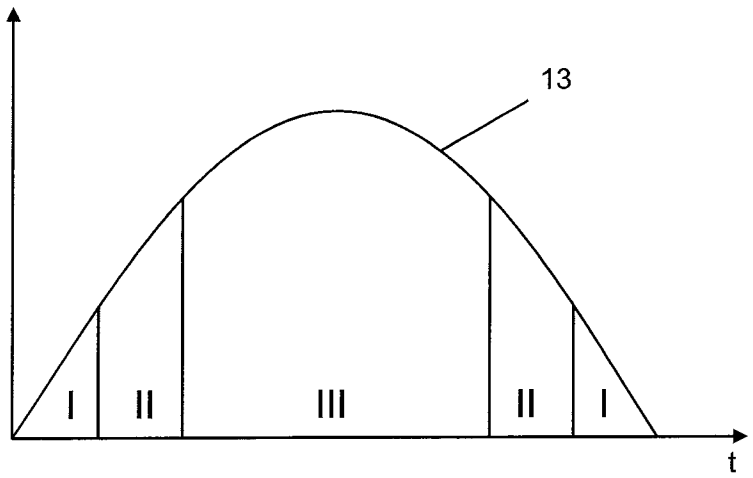
FIG. 4 shows a graph for illustration of the functionality of the LED lighting device of FIG. 1.

FIG. 4 shows a schematic graph of a half-wave 13 of the chain voltage, which also equals the supply voltage. The X axis of the graph represents time t, whilst the Y axis represents the amplitude as any unit. The control means 10 received the chain voltage or a signal proportional to the same as an input signal. At the start of the half-wave 13 the LED whole chain 9 is switched to switch state I, so that the LED whole chain 9 comprises a first, low through voltage. In this way at least the LEDs of LED part group 11*a* can be lit with a comparatively low chain voltage. When the chain voltage increases, or when the same in particular exceeds the second through voltage of the LED whole chain 9 in switch state II, the control means 10 switches the LED whole chain 9 into the second switch state II. In this switch state the LEDs of LED part groups 11*a, b* will be lit. As soon as the chain voltage exceeds the third through voltage of the third switch state III of the LED whole chain 9 the switch state III will be adjusted by the control means 10, so that all three LED part groups 11*a, b, c* will be lit. On the falling edge of the half-wave 13 the process is repeated in reverse. By switching the LED whole chain 9 in the described way it is possible to adjust the through voltage of the LED whole chain 9 much better to the relevant current chain voltage of the half-wave 13, and thus to improve the degree of effectiveness and the lighting time of the LED whole chain 9.

In order to activate or LEDs in the LED part groups 11*a, b, c* on average for the same period, or to achieve an improved spatial distribution of the lit LEDs, the different variants of the switch states I and II are activated by the control means 10. In this way it can for example be envisaged that the variant shown in FIG. 2*a* is activated with a first half-wave, the variant shown in FIG. 3*a* activated in a second half-wave, and a further variant of the switch state I activated in a third half-wave, whereby the shorting link 12*b* is open in the further variant. If the frequency of the AC voltage supply is sufficiently high the three LED part groups 11*a, b, c* of this distribution will be perceived as evenly lit by a human observer, as the rapid change is not visible to the human eye.

Although only three LED part groups 11*a, b, c* are illustrated in FIG. 2*a, b, c*, or in 3*a, b*, the number of LED part groups can be chosen as desired. In this way it is possible that only two LED part groups are envisaged in the whole chain 9, although it is also possible that four, five or more LED part groups are switched in series in the whole chain 9.

Figure 5:
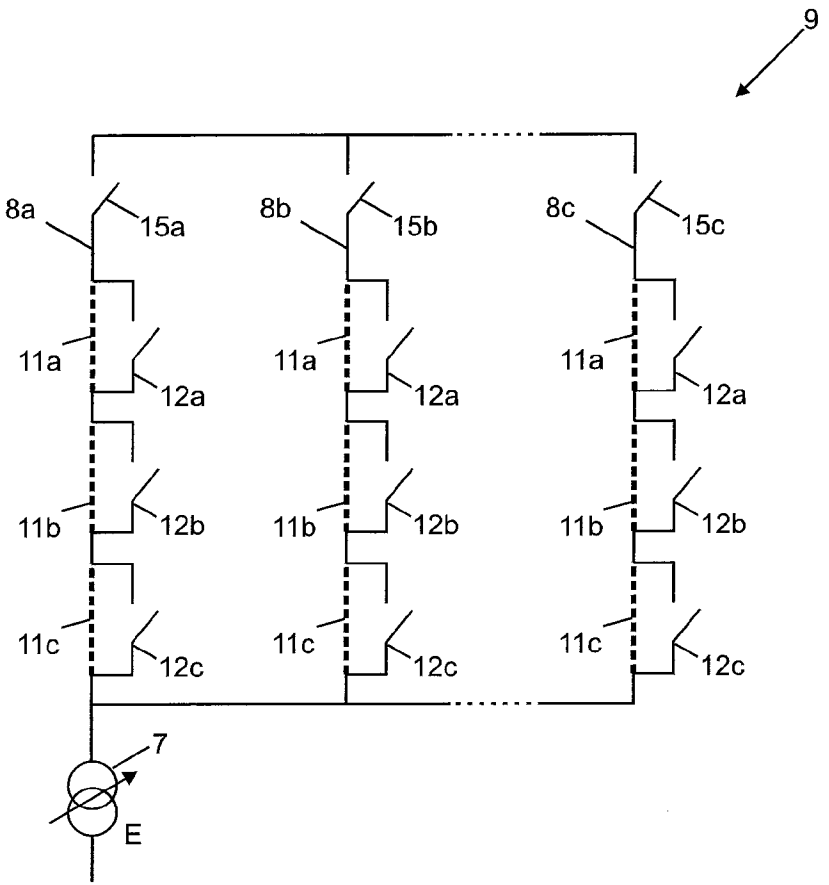
FIG. 5 shows a schematic illustration of a further embodiment example of a whole chain of LEDs of FIG. 1.

FIG. 5 shows a schematic illustration of a further LED whole chain 9, comprising several LED strands 8*a, b, c*, whereby further LED strands are possible, as is indicated by means of the dots. Each one of the LED strands 8*a, b, c* of this embodiment example comprises three (or more) LED part groups 11*a, b, c* with shorting links 12*a, b, c* and an accumulative switching means 15*a, b, c* switched in series with the same, which is designed as a controllable switch in each case and enables an interruption of the LED strand 8*a, b* or *c*. In this embodiment it is possible to adjust the total through voltage between input E and output A of the whole chain 9 in the described way, for one thing by activating or deactivating the shorting links 12*a, b, c* in the various LED strands 8*a, b, c*.

With one possible embodiment of the whole chain 9 the first LED strand 8*a* comprises only green LEDs, the second LED strand 8*b* only green LEDs, the third LED strand 8*c* only blue LEDs. Further possible LED strands also comprise LEDs of only one colour, whereby the colour is selected from the groups red, green, blue and white.

The on or off switching of LED strands 8*a, b, c* also makes it possible to change the distribution of incoming power and/or the incoming chain current with the control means 10. In this embodiment it is thus possible that the control means 10 controls the LED whole chain 9 in such a way that the same firstly comprises a through voltage that is adapted to suit the current chain voltage, and can secondly be controlled by switching LED strands 8*a, b, c* on and off to distribute the incoming current.

FIG. 5 once again shows the current sink 7, which is designed as a controllable or regulatable current sink that is controlled with a sinus signal that is synchronous with the mains voltage or the filtered mains voltage or the supply voltage in this embodiment, so that the assemblies comprising the current sinks 7 and the LED whole chain 9 receives a chain current that is synchronous with the sinus signal.

Figure 6:
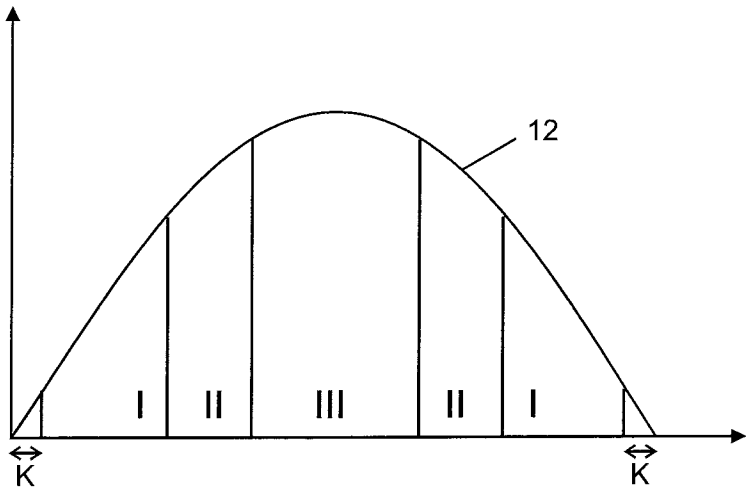
FIG. 6 shows a graph for illustration of the activation of the LED lighting device of FIG. 1.

Due to the zero-voltage the supply voltage or chain voltage is lower at the start and the end of the half-wave 13 than the lowest through voltage of the LED whole chain 9 that can be set, as is schematically illustrated in FIG. 6. The control means 10 is designed to bridge the LED whole chain 9 at the start and the end of the half-wave 13 during an activation period K, during which the chain voltage is lower than the lowest through voltage of the switch states I, II, III. Bridging is realised in that the shorting links 12*a, b, c* and the accumulative switching means 15*a, b, c* are closed. During this period the current sink 7 can allow the flow of chain current, so that the performance factor requirements of the LED lighting device 1 continue to be fulfilled.

LIST OF REFERENCE NUMBERS

1 LED lighting device
2 AC voltage supply
3 Input
4 Mains filter
5 Rectifier
6 PFC module
7 Current sink
8 LED strand
9 LED whole chain
10 Control means
11 LED part group
12, 12*a, b, c* Shorting link
13 Half-wave
14 Not assigned
15, 15*a, b, c* Accumulative switching means
E Input
A Output
t Time
K Activation period

The invention claimed is:

1. An LED lighting device for AC voltage supply, the device comprising:

a plurality of LEDs forming a whole chain, wherein the plurality of LEDs are divided into a plurality of LED part groups, wherein a supply voltage with changing amplitude is presented in the LED lighting device, the whole chain comprising a plurality of LED strands, wherein each LED strand is formed by a plurality of said LED part groups that are arranged in series with respect to each other;

shorting links, each configured to bridge a respective LED part group of a respective LED strand; and a control means, wherein the control means is configured to control the shorting links to place each of the plurality of LED strands in at least two switch states, wherein the through voltage of each strand is different when said LED strand is in the switch states, respectively wherein the plurality of LED strands are switched electrically parallel with respect to each other; and wherein at least one of the LED strands comprises an accumulative switching means, wherein the accumulative switching means is electrically switched in series with the respective LED part groups of said at least one LED strand.

2. The LED lighting device according to claim 1, wherein the control means is configured to change the switch states in such a way that the switch state with the highest through voltage is activated, wherein the through voltage is lower than or equal to the supply voltage.

3. The LED lighting device according to claim 1, wherein the control means comprises a programmable data processing means.

4. The LED lighting device according to claim 1, wherein the control means is configured to randomly access the shorting links of the LED strand.

5. The LED lighting device according to claim 1, wherein the control means is configured to control the shorting links to place the LED strands in several variants of a switch state, wherein the variants comprise the same through voltage of the LED strands, but a different selection of bridged LED part groups.

6. The LED lighting device according to claim 1, wherein the waveform of the supply voltage is formed by a repeating wave section, wherein the different switch states are taken up during the wave section.

7. The LED lighting device according to claim 1, further comprising a current sink switched in series with the whole chain, to which a supply voltage and a supply current is applied, wherein the current sink is configured to control the chain current for the whole chain, so that the time curve of the supply current is synchronised with the time curve of the supply voltage or the time curve of a mains voltage of the AC voltage supply.

8. The LED lighting device according to claim 1, wherein the LED strands and/or the LED part groups are coloured differently.

9. The LED lighting device according to claim 1, wherein the control means is configured to close all shorting links and all accumulative switching means during an activation period, when the supply voltage is lower than the lowest through voltage of the different switch states.

10. A method for operating the LED lighting device according to claim 1, wherein the control means changes the switch state of the whole chain depending on the amplitude of the supply voltage.

* * * * *